US006742597B2

(12) United States Patent
Van Winkle et al.

(10) Patent No.: US 6,742,597 B2
(45) Date of Patent: Jun. 1, 2004

(54) SAFETY CHECK VALVE FOR COILED TUBING

(75) Inventors: Denzal Wayne Van Winkle, Santa Maria, CA (US); Andrew Campbell, Fettercairn (GB)

(73) Assignee: Varco I/P, Houston, TX (US)

( * ) Notice: Subject to any disclaimer, the term of this patent is extended or adjusted under 35 U.S.C. 154(b) by 24 days.

(21) Appl. No.: 10/151,502

(22) Filed: May 20, 2002

(65) Prior Publication Data

US 2003/0213597 A1 Nov. 20, 2003

(51) Int. Cl.[7] ..... E21B 33/03

(52) U.S. Cl. ..... 166/380; 166/381; 166/77.2; 166/85.1; 166/95.1

(58) Field of Search ..... 166/380, 381, 166/77.2, 85.1, 85.4, 87.1, 95.1, 80.1

(56) References Cited

U.S. PATENT DOCUMENTS 4,325,434 A 4/1982 Roberts
5,201,371 A 4/1993 Allen

*Primary Examiner*—William Neuder
(74) *Attorney, Agent, or Firm*—Law Office of Tim Cook P.C.

(57) ABSTRACT

A spring-loaded check valve, mounted between a coiled tubing stripper and a BOP stack seals well bore pressure from the atmosphere when the coiled tubing is removed from the well bore. When no coiled tubing is in use, the check valve is shut against well bore pressure. When coiled tubing is inserted through the stripper and before the coiled tubing enters the BOP stack, the coiled tubing butts against the check valve and opens it, permitting insertion of the coiled tubing.

11 Claims, 8 Drawing Sheets

FIG.7D
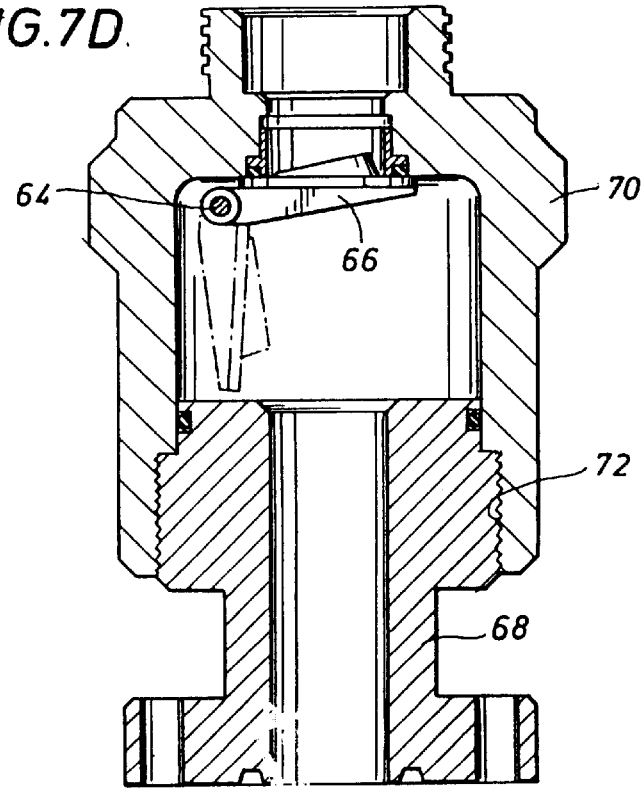
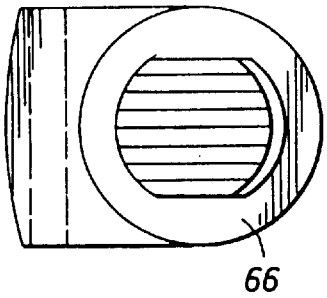
FIG.8B
FIG.8C
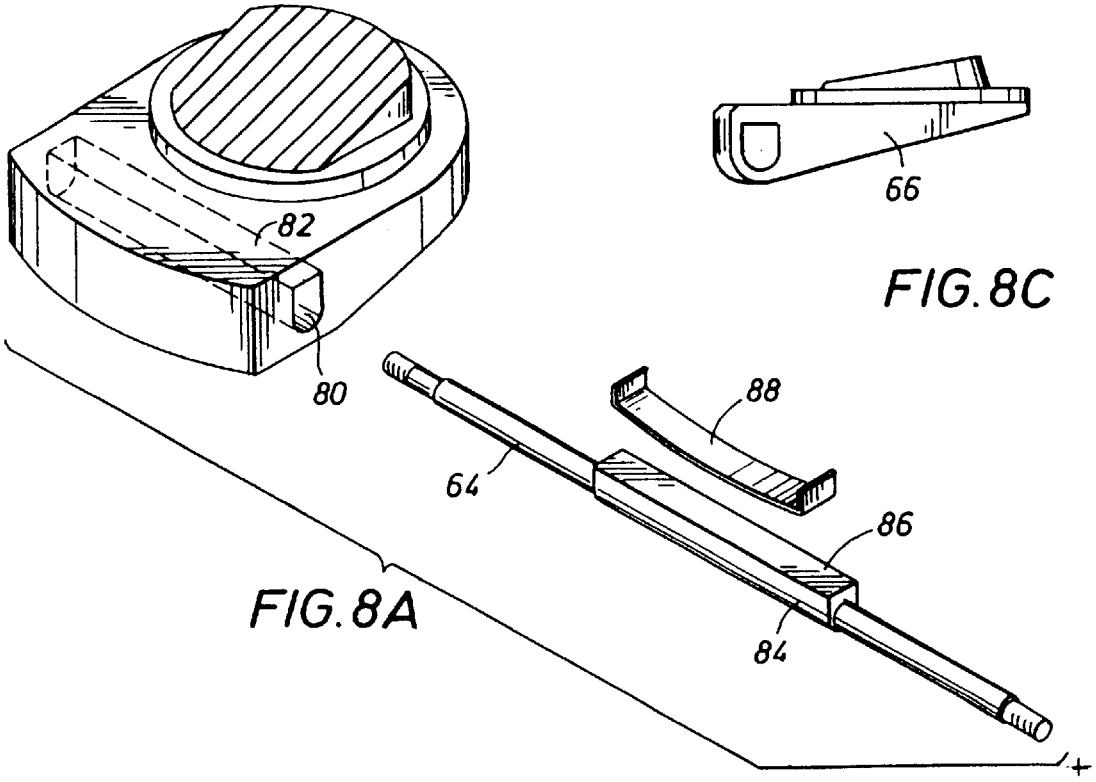
FIG.8A

SAFETY CHECK VALVE FOR COILED TUBING

FIELD OF THE INVENTION

The present invention relates generally to the field of blowout preventers (BOPs) used with coiled tubing, and, more particularly, to a safety check valve adapted for use with a blowout preventer used with coiled tubing.

BACKGROUND OF THE INVENTION

Coiled tubing has grown in popularity and acceptance in the oil and gas industry in recent years. Coiled tubing is typically inserted into a well bore by way of an injector, a tubing stripper, and a BOP stack. More often than not, the well bore is under live pressure when the coiled tubing is run into or retrieved from the well. When the tubing is moving, the pressure is retained between the well and the coiled tubing outside diameter by the stripper. When the tubing is not moving, or is out of the well bore, a BOP valve retains the well pressure.

Coiled tubing systems typically include a depth counter display provided to a coiled tubing unit operator in a control cabin. The depth counter indicates to the operator how far down the coiled tubing is in the well, and thus this display also indicates when the coiled tubing is about to exit the stripper. The normal procedure is to stop coiled tubing travel when the end of the coiled tubing is above the BOP, but has not yet exited the stripper. When the coiled tubing is stopped, the BOP valve is closed, the pressure between the BOP and the stripper is bled down, and the coiled tubing is then withdrawn from the well.

If the coiled tubing unit operator did not have an indication of the length of the coiled tubing, the tubing could be pulled out of the stripper with full well pressure behind it, causing an uncontrolled release of well fluids until the BOP could be shut. Such an event could even result in a catastrophic fire or a deadly hydrogen sulfide gas leak. Thus, it is critical for the operator to know the precise location of the end of the coiled tubing.

The depth counter commonly comprises a wheel in rolling contact with the coiled tubing and coupled to an odometer. If the wheel slips against a slick coiled tubing, then a false reading will occur. Furthermore, if the coiled tubing breaks down hole, the operator has no means of knowing where the break occurred and thus the length of the tubing remaining intact below the stripper is unknown. In either case, the operator may pull the coiled tubing out of the stripper, resulting in the escape of well bore fluids at full well pressure, until the BOP valve can be closed.

Thus, there remains a need for a fail safe device which will retain well bore fluids under pressure if coiled tubing is extracted from a stripper before the BOP valve is shut. The present invention is directed to solution to this problem in the art.

SUMMARY OF THE INVENTION

The present invention provides a biased or spring-loaded check valve between the stripper and the BOP stack. When no coiled tubing is in use, the check valve is shut against well bore pressure. When coiled tubing is inserted through the stripper and before the coiled tubing enters the BOP stack, the coiled tubing butts against the check valve and opens it, permitting insertion of the coiled tubing.

These and other features and advantages of this invention will be readily apparent to those skilled in the art from a review of the following detailed description along with the accompanying drawings.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIGS. 7*a* through 7*d* depict side views of the safety check valve, including an exterior semaphore feature.

FIG. 8*a* is an exploded perspective view of a check valve disk and its associated mounting hardware.

FIG. 8*b* is a top view of the check valve disk and FIG. 8*c* is a side view of the disk.

DETAILED DESCRIPTION OF A PREFERRED EMBODIMENT

Figure 1:
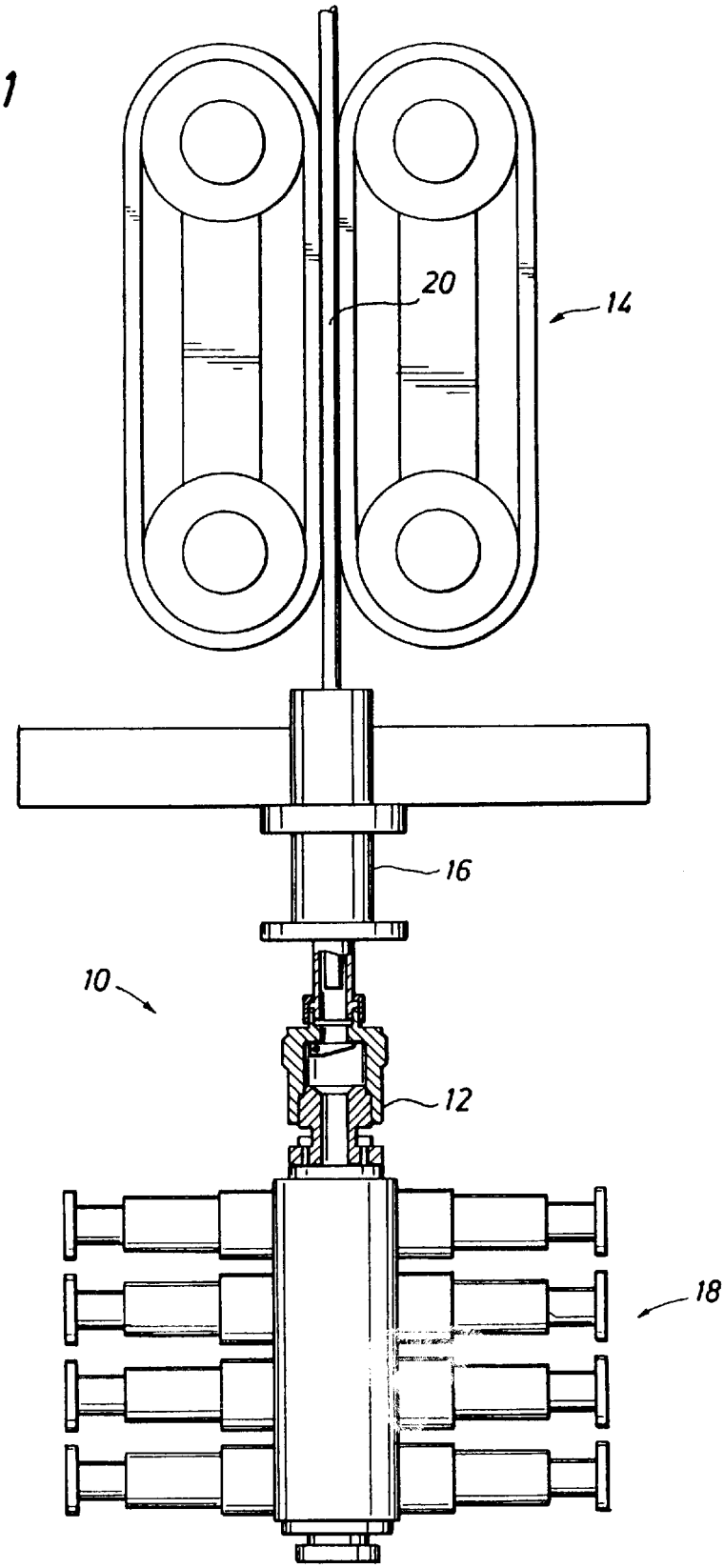
FIG. 1 is a side elevation view in partial section of a wellhead including the safety check valve of the present invention.

FIG. 1 shows a wellhead system 10 which incorporates a safety check valve 12 of the present invention. The wellhead system 10 includes a coiled tubing injector 14, a tubing stripper 16, and a quad BOP 18, and the injector, the stripper, and the BOP may be of conventional design. The safety check valve 12 is preferably mounted between the stripper 16 and the BOP stack, but may be constructed as an integral portion of the stripper, so long as the check valve is positioned vertically above the BOP 18. The injector inserts coiled tubing 20 through the stripper and the check valve and into the BOP, and is also adapted to retract the coiled tubing from the wellhead system.

Figure 1B:
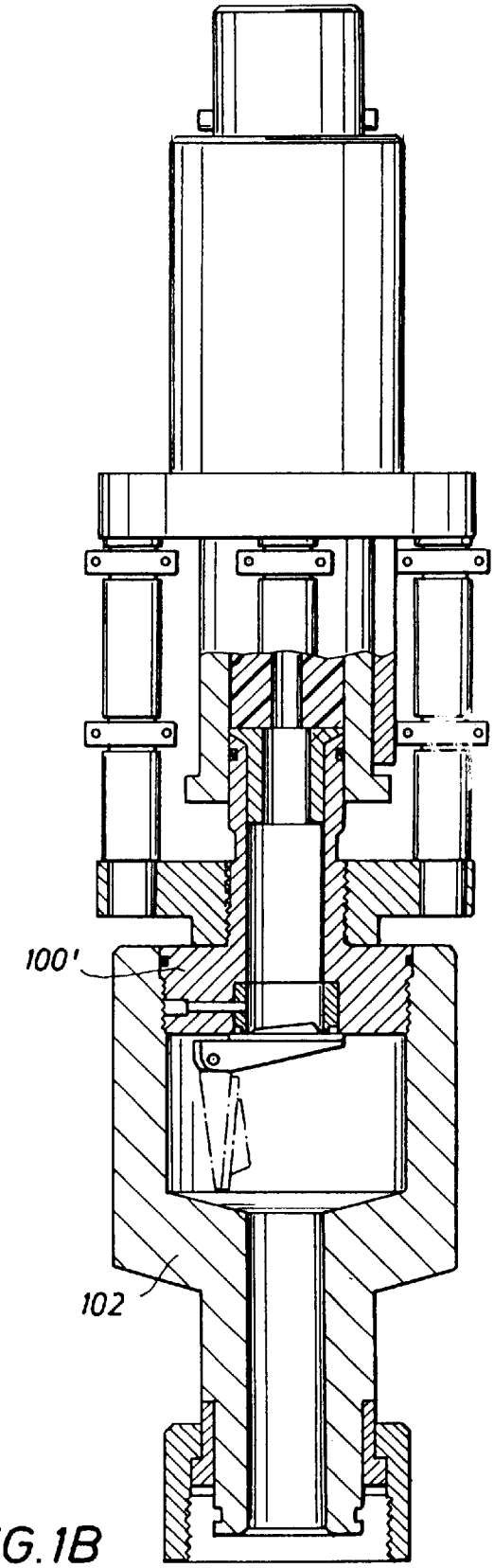
FIG. 1B is a side section view of a stripper modified to include the safety check valve formed as an integral part of the stripper.
Figure 3:
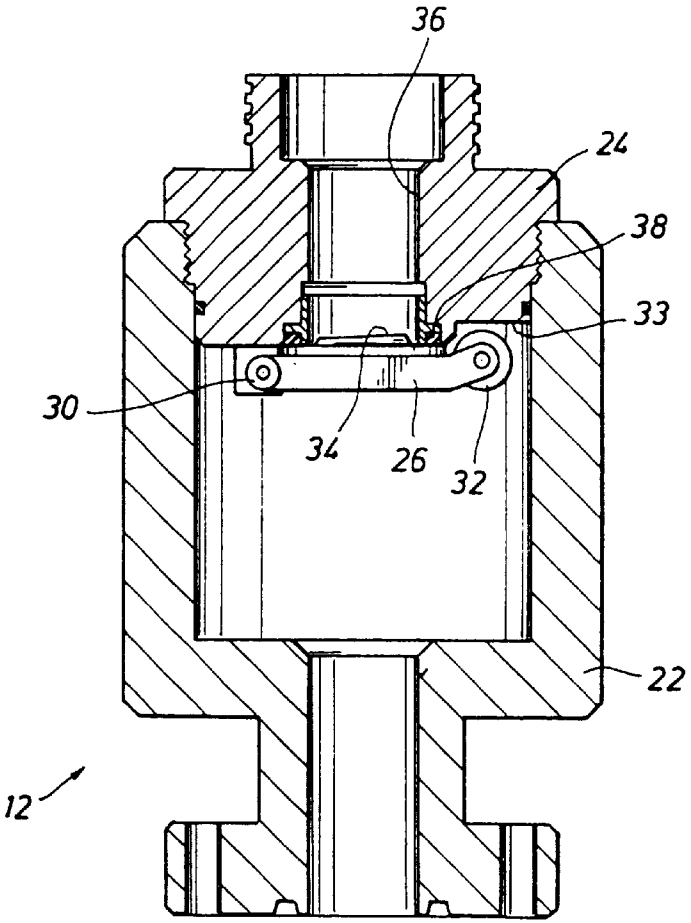
FIG. 3 is a side section view of a safety check valve of the invention, depicted in a closed condition.
Figure 2:
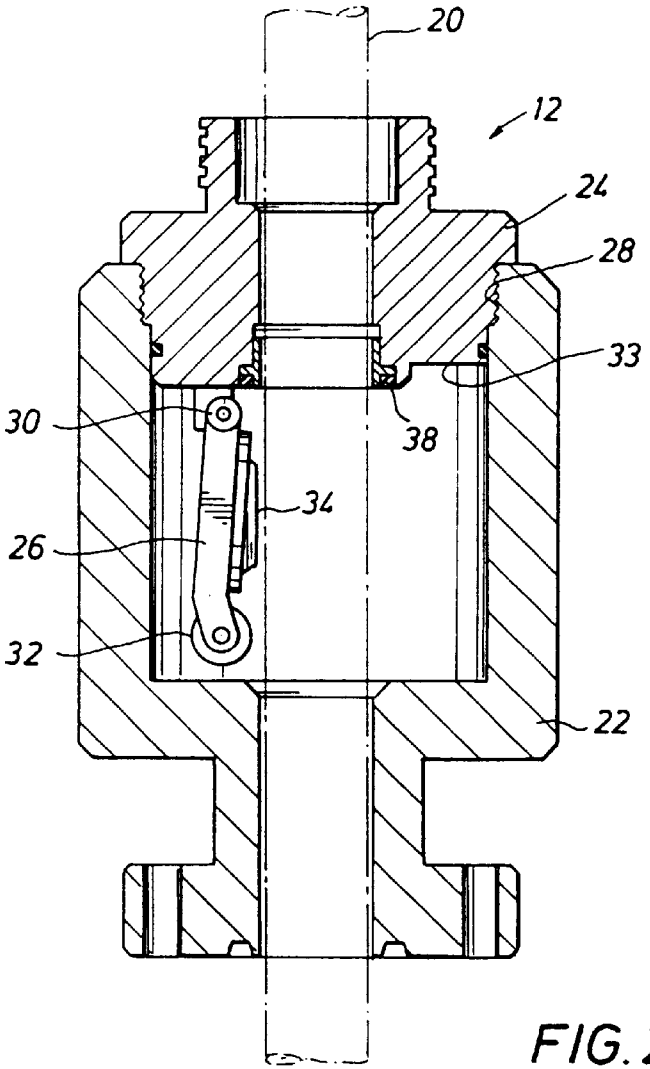
FIG. 2 is a side section view of a safety check valve of the invention, depicted in an open condition.

FIGS. 2 and 3 illustrate additional details of the check valve 12. FIG. 2 depicts the check valve in the open position, and FIG. 3 depicts it closed. The check valve comprises a body 22, a cap 24, and a check valve disk 26. The cap 24 attaches to the body by appropriate means, such as for example by threads 28. Rather than having a cap, the check valve may be formed as a part of the stripper (FIG. 1*b*).

Mounted within the body 22 is the disk 26 and the disk is spring-loaded with a biasing means at a pivot point 30 to snap shut when no coiled tubing 20 is run through the check valve. The disk preferably includes a roller 32 to reduce friction against a sloping contact pad 34 as coiled tubing moves into and out of the check valve. When the valve is closed, the roller fits into a recess 33 in the cap, as shown in FIG. 3. The upper surface (when the check valve is shut) of the disk 26 includes the sloping contact pad 34. When the check valve is shut, with the disk in a horizontal configuration as shown in FIG. 3, the contact pad 34 slopes upward. That way, when coiled tubing is inserted into the check valve, the contact between the coiled tubing and the contact pad 34 immediately imparts a rotational force on the disk. This feature of the invention is shown and described below with regard to FIG. 6. When the check valve shuts, the contact pad fits up into a bore 36 in the cap 24, and the flat of the disk 26 contacts an O-ring seal 38 to seal against well bore pressure.

Figure 5:
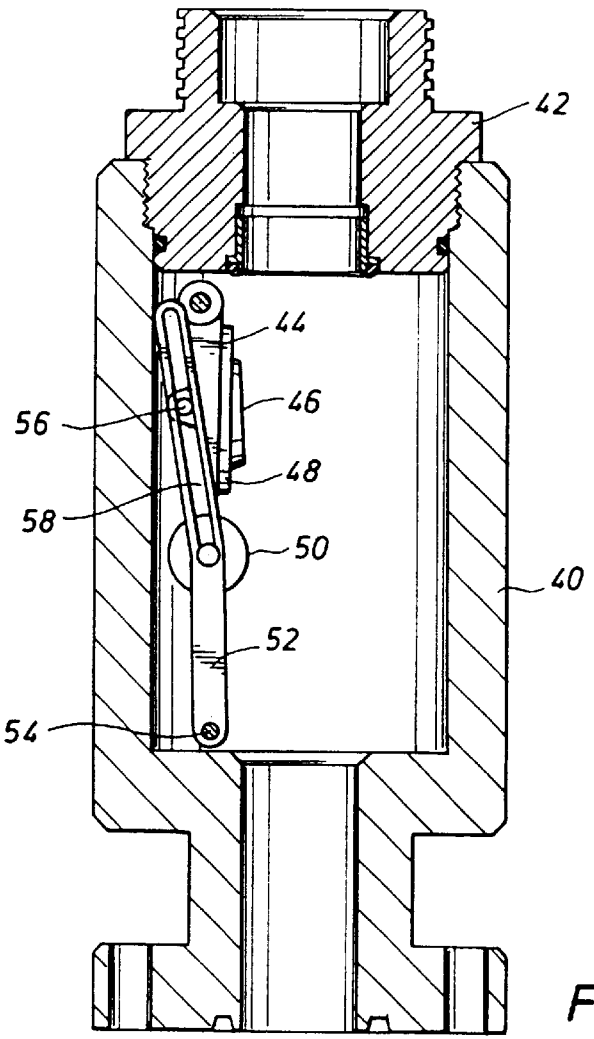
FIG. 5 is a side section view of an alternative preferred embodiment of a check valve of the invention, including an articulated actuator, depicted in an open condition.
Figure 4:
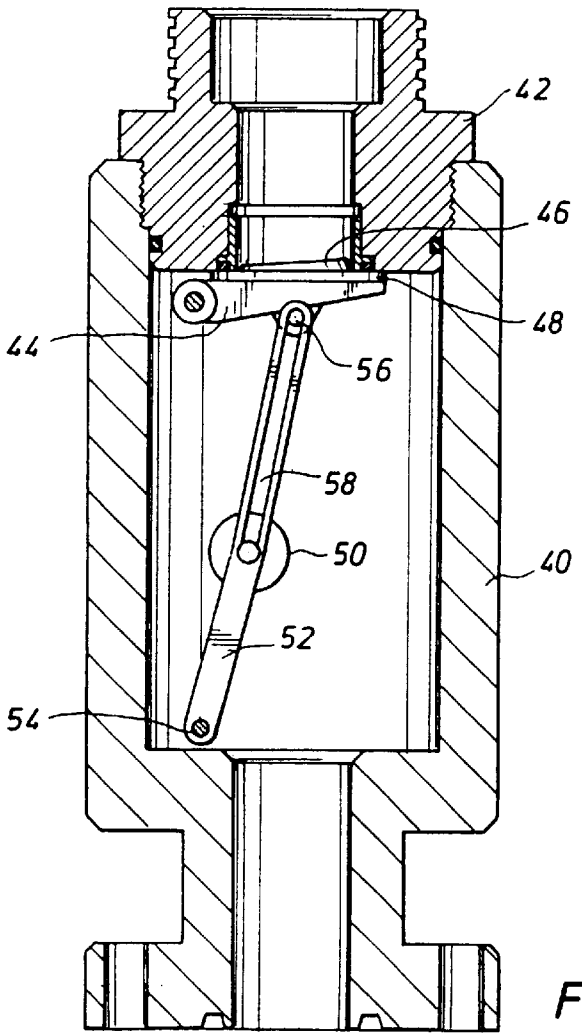
FIG. 4 is a side section view of an alternative preferred embodiment of a check valve of the invention, including an articulated actuator, depicted in a closed condition.

FIGS. 4 and 5 depict an alternative embodiment of the safety check valve of the invention. The safety check valve includes a body 40, a cap 42, and a valve disk 44. The disk 44 includes a contact pad 46 and a flat region 48 surrounding the pad 46. In this embodiment, the roller on the disk has been eliminated, thus there is no need for the recess 33 (FIGS. 2 and 3). Instead, the valve includes a roller 50 mounted on a pivot arm 52 for rotation movement about a pivot 54. The pivot arm 52 is slidingly mated with a connector 56 on the underside of the disk, and the connector 56 slides along a channel 58 in the pivot arm during movement of the disk.

Figure 6:
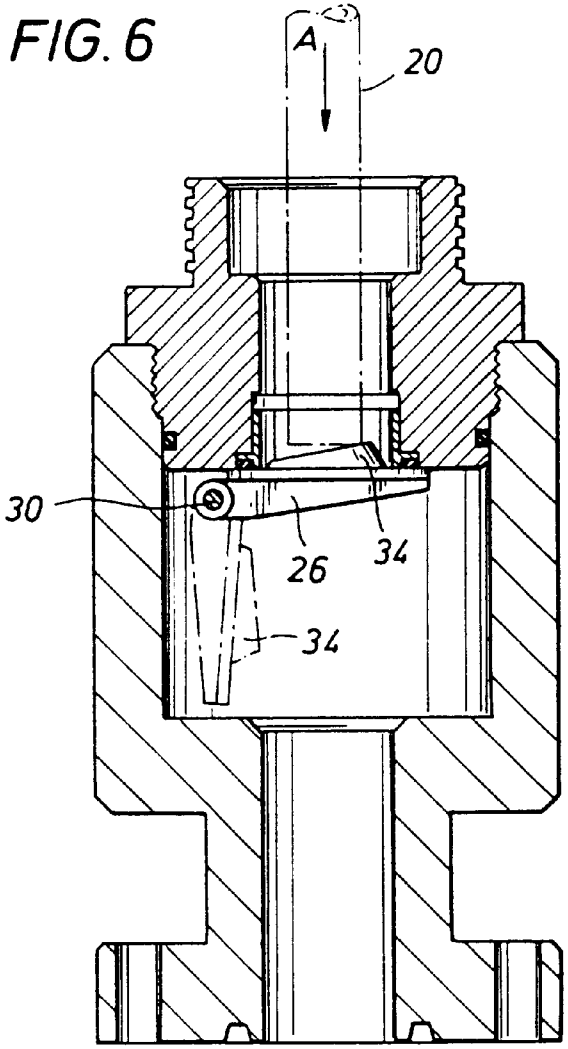
FIG. 6 is a side section view of a safety check valve, illustrating the abutment opening feature of the invention.
Figure 7C:
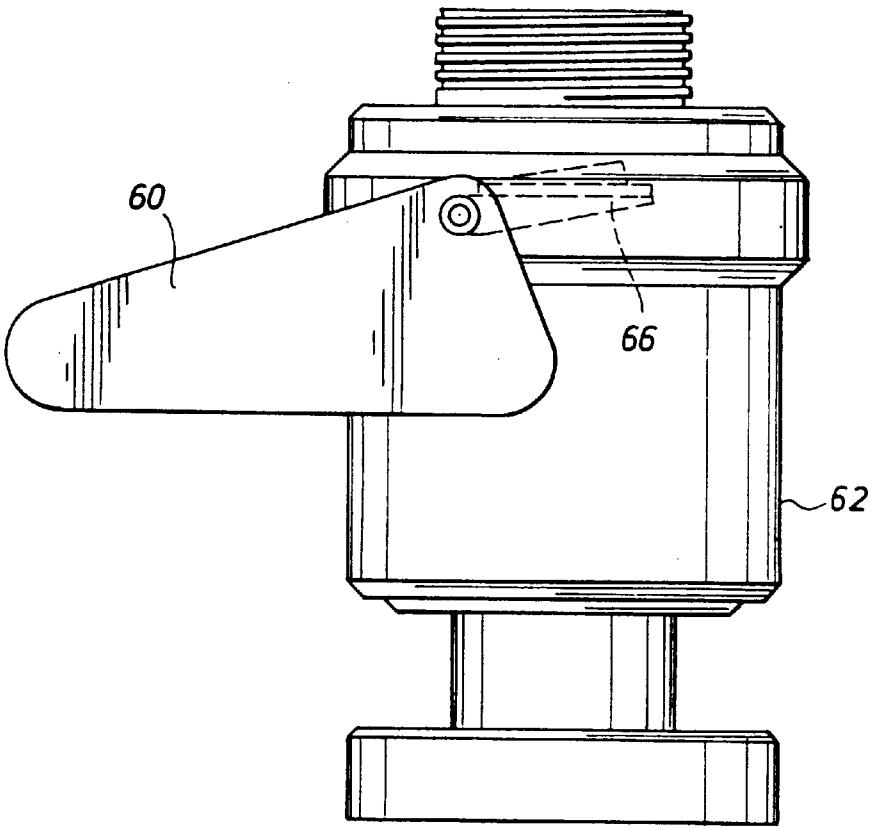
Figure 7B:
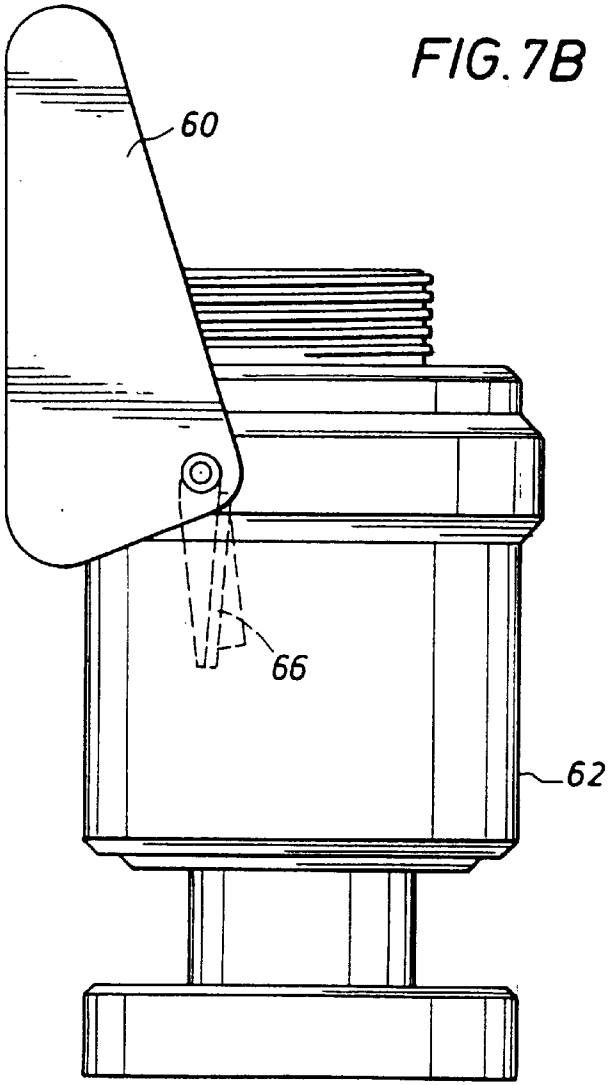

The contact pad 34 is illustrated in FIG. 6. Coiled tubing 20, inserted into the check valve in direction A, contacts the contact pad 34 at one point, developing rotational force on the disk 26 about its pivot point 30. Without the contact pad feature, the force of contact between the coiled tubing and the disk would be translated to the pivot point, and could possibly cause premature failure of the pivot point 30 or the biasing means.

Figure 7A:
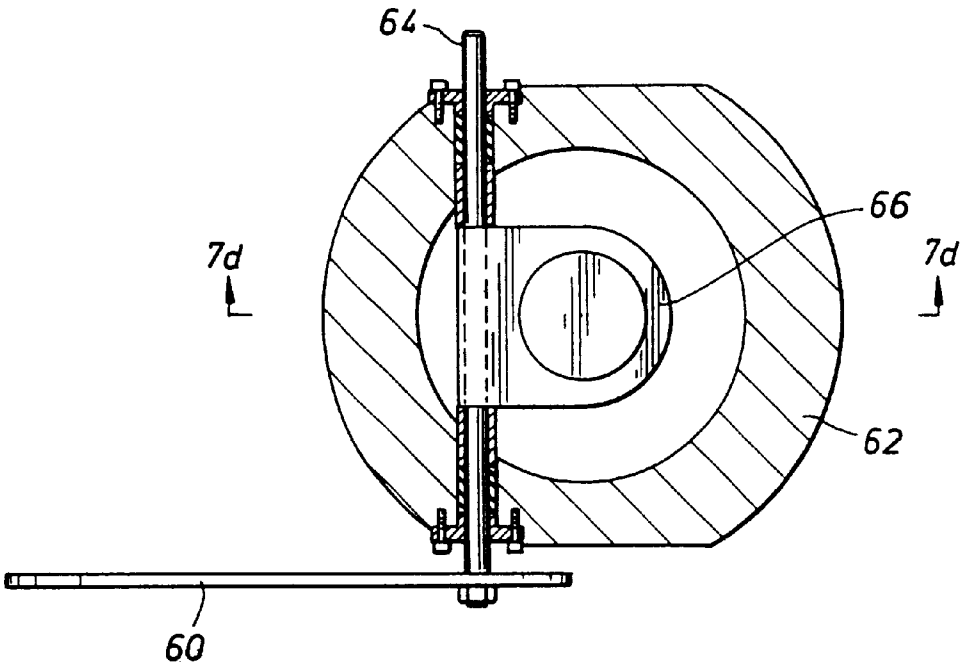

FIGS. 7*a* through 7*d* depict another preferred embodiment of the invention. The valve may also include a semaphore 60 external to a body 62 of the valve. The semaphore 60 is mounted on an axle 64 which extends through the body, and a disk 66 is mounted for common movement with the semaphore. In this embodiment, the valve includes a body 68 and a cap 70, coupled together as at threads 72. The section view of FIG. 7*d* is taken along section lines D—D of FIG. 7*a*, to illustrate the alternative arrangement of the body and cap, which accommodates the semaphore.

The semaphore provides an externally visible means for the operator when the check valve is shut, also providing an absolute indication that the coiled tubing has cleared the check valve. At that point, the operator stops extracting the coiled tubing from the well bore to shut the BOP valve and secure the well before the coiled tubing is pulled out of the stripper.

FIGS. 8*a* through 8*c* show details of the structure and mounting of the disk 66. The disk 66 has a horizontal hole 80 through it with at least one flat surface 82 within the hole. The axle 64 includes a mating mount 84 to closely fit the hole 82 and the mount 84 also includes a complementary flat 86. The mating flats 82 and 86 prevent relative rotational movement between the disk 66 and the axle 64. For ease of manufacture, a spring 88 is preferably inserted into the hole 80 before the axle is inserted for a robust friction fit between them and further to provide vertical travel of the valve disk to assure full contact as the disk contacts it O-ring seal.

Figure 9A:
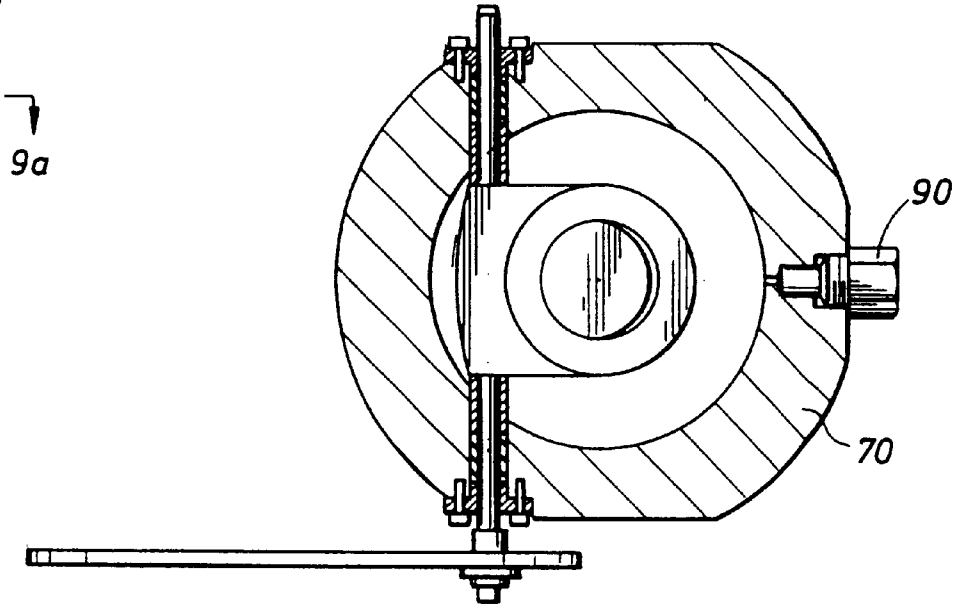
FIG. 9*a* is a top section view of a check valve of the present invention further including a bypass valve.
Figure 9B:
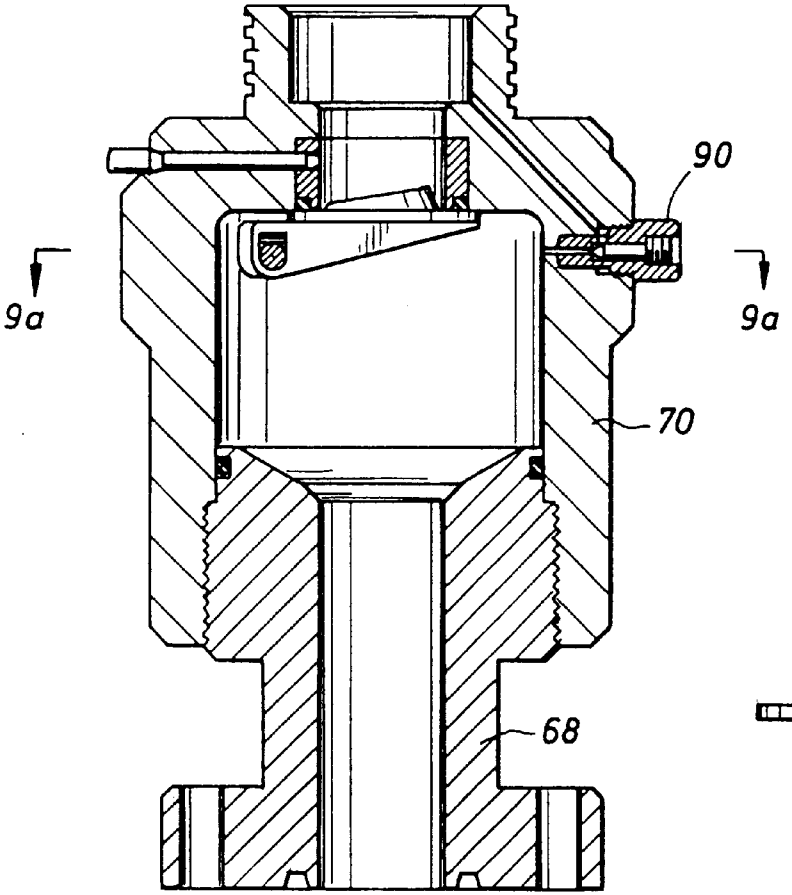
FIG. 9*b* is a side section view of the check valve having a bypass valve.

FIGS. 9*a* and 9*b* illustrate that the check valve may also include an equalizing valve 90 around the check valve. This feature may be important when inserting coiled tubing into the check valve, since pressure may have been trapped below the disk.

Figure 1A:
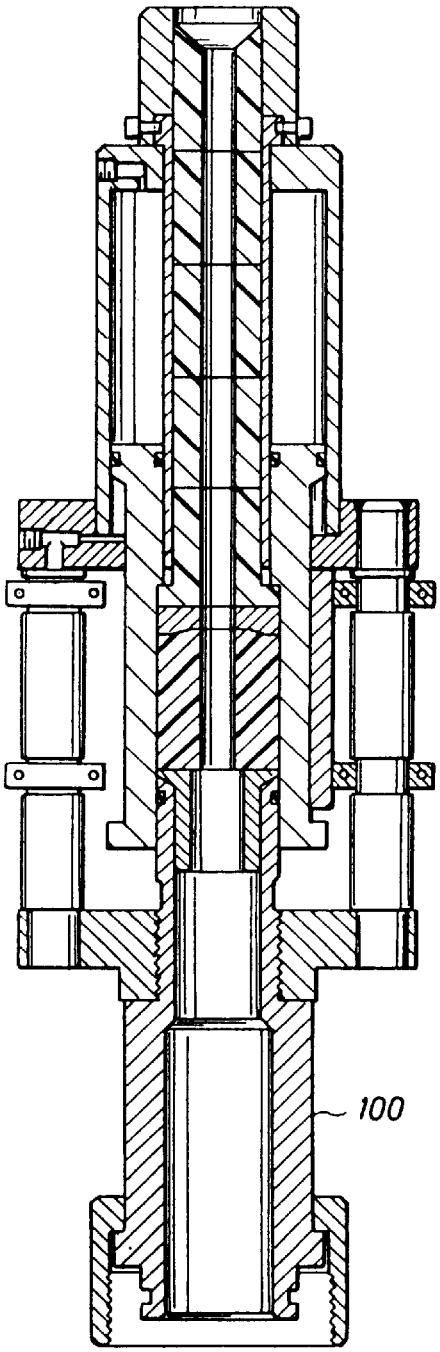
FIG. 1A (PRIOR ART)
FIG. 1A is a side section view of a prior art stripper.

Finally, FIGS. 1A and 1B illustrate one way to include the safety check valve of the present invention as an integral part of a stripper. FIG. 1A shows a known stripper, which includes a body extension 100 extending down to mount to a BOP stack. In FIG. 1B the body extension is truncated into an extension 100', which in turn mates with a heck check valve body 102 as previously described.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A wellhead system comprising:

a. a coiled tubing injector;

b. a tubing stripper below the tubing injector to receive coiled tubing from the injector;

c. a blowout preventer below the stripper; and d. a check valve between the blowout preventer and forming an integral part of the stripper.

2. The wellhead system of claim 1, wherein the check valve comprises:

a. a body defining a valve seat;

b. a cap attached to the body; and c. a valve disk.

3. The wellhead system of claim 2, wherein the body is attached above the blowout preventer.

4. The wellhead system of claim 2, further comprising a roller attached to the disk, the roller adapted to ride on a tubular as it moves through the valve.

5. The wellhead system of claim 1, further comprising a pressure bypass around the check valve.

6. In a wellhead system having a coiled tubing injector and a blowout preventer, a safety check valve comprising:

a. a body attached above the blowout preventer;

b. a cap attached to the body; and c. a valve disk; and d. an axle on which the disk is mounted, the axle extending through the body.

7. The safety check valve of claim 6, further comprising a sloping contact pad on the disk.

8. The safety check valve of claim 7, further comprising a semaphore mounted on the axle outside the body.

9. A method of preventing the uncontrolled release of fluids under pressure from the a wellhead having a coiled tubing injector, a tubing stripper below the tubing injector to receive coiled tubing from the injector, and a blowout preventer below the stripper, the method comprising the steps of installing a check valve between below the blowout preventer and as an integral part of the stripper.

10. A wellhead system comprising:

a. a coiled tubing injector;

b. a tubing stripper below the tubing injector to receive coiled tubing from the injector;

c. a blowout preventer below the stripper; and d. a check valve between the blowout preventer and the stripper, wherein the check valve comprises a body defining a valve seat, a cap attached to the body, a valve disk.

11. A wellhead system comprising:

a. a coiled tubing injector;

b. a tubing stripper below the tubing injector to receive coiled tubing from the injector;

c. a blowout preventer below the stripper;

d. a check valve between the blowout preventer and the stripper; and e. a pressure bypass around the check valve.

* * * * *